United States Patent [19]

Meyer

[11] 4,165,583

[45] Aug. 28, 1979

[54] WINDOW-RAISER, IN PARTICULAR FOR AUTOMOBILE VEHICLES

[75] Inventor: Jean-Claude Meyer, La Membrolle sur Choisille, France

[73] Assignee: Compagnie Industrielle de Mecanismes, France

[21] Appl. No.: 911,326

[22] Filed: Jun. 1, 1978

[30] Foreign Application Priority Data

Jun. 6, 1977 [FR] France ..... 77 17272
Feb. 27, 1978 [FR] France ..... 78 05551

[51] Int. Cl.[2] ..... E05F 15/16

[52] U.S. Cl. ..... 49/349; 49/362; 74/30

[58] Field of Search ..... 49/349, 348, 362; 74/29, 30, 31

[56] References Cited

U.S. PATENT DOCUMENTS 1,508,609 9/1924 McArthur ..... 49/348
3,770,313 11/1973 Jimenez ..... 49/349 X

*Primary Examiner*—Philip C. Kannan
*Attorney, Agent, or Firm*—Holman & Stern

[57] ABSTRACT

The window-raiser comprises a window support and a guiding device and an actuating device for this support. The actuating device comprises a U-shaped rack which is pivoted to the window support in the region of the apex of the U by a pin, a drive pinion having a fixed axis and meshed with the rack and a fixed pivot received in a longitudinal slot in the rack.

19 Claims, 11 Drawing Figures

46b
48
D1
65
7
7
47
8
8
68
49
51
69
72
46
42
73
71
44
59
77
76
41
61
74
79
61
80a
43
80b
56
59

44
46
71
73
69
72

WINDOW-RAISER, IN PARTICULAR FOR AUTOMOBILE VEHICLES

The present invention relates to window-raisers in particular for automobile vehicles, of the type comprising a window or glass support which slides in rectilinear translation, guide means and actuating means for said support.

An object of the invention is to provide a window-raiser which is particularly reliable, simple, light, small in overall size and highly efficient.

According to the invention, there is provided a window-raiser of the aforementioned type, wherein the actuating means comprise a U-shape rack which is pivotally connected to said support by a pin in the region of the apex of the U, a drive gear pinion having a fixed axis of rotation and in mesh with the rack, and a fixed pivot received in a longitudinal slot in the rack.

In a first embodiment of the invention, the teeth of the rack comprise two rectilinear and parallel portions which are interconnected by a semi-circular portion, the pin extending through the centre of the semi-circular portion and the axes of the pivot and semi-circular portion being coincident when the pinion engages said semi-circular portion.

In order to avoid a temporary interruption of movement midway of the travel of the window support, the rack preferably carries in this case a semi-circular member which is superimposed on the semi-circular portion thereof and has the same effective circumference and cooperates without sliding with a track which is parallel to the direction of displacement of said support and rigid with the latter, the pin pivoting the rack to said support extending through a slot in said support which is parallel to the track.

In another embodiment of the invention which permits avoiding in a more simple manner the temporary interruption of movement midway of the travel of the support element, the pivot is laterally offset from the path of the pin, in a direction away from the pinion, the teeth of the rack comprising two branches of small curvature disposed on each side of the slot, and a highly curved region interconnecting the two branches and adjacent to the pivotal connection pin.

With this arrangement, if it is assumed that the window support initially occupies one of its end positions, the rack is constrained under the action of the drive pinion to undergo simultaneously a continuous movement of translation ensuring the raising or lowering of the window, and a continuous movement of rotation in the course of which the rack turns over, which permits a small overall size of the window-raiser. All of the rack teeth are in fact defined by a continuous pitch curve which is none other than the envelope of the pitch circle of the drive pinion in the relative movement between the latter and the rack. This curve may be obtained either by a geometric tracing out or point-by-point plotting from parametric Cartesian coordinates established by taking for the coordinate axes the longitudinal axis of symmetry of the rack and an axis which is perpendicular to this longitudinal axis of symmetry and intersects the centre of the pin pivotally connecting the rack to the window support, the parameter being the distance between the centre of the pivotal connection pin and the axis perpendicular to the direction of translation intersecting the centre of the drive pinion and the centre of the guide pivot.

In this modification, the motion of the window support is not strictly uniform, but the variation in the speed of translation for a uniform speed of the drive pinion may be less than 15%, which is quite satisfactory since this variation is progressive.

The two embodiments described hereinbefore enable a large number of teeth to be provided on the rack for a given travel of the window. Consequently, a large number of teeth may be given to the drive pinion, which reduces the load on each tooth and provides an improved meshing. The drive torque may therefore be relatively low, resulting in an economy of power which is advantageous in the case of an electric motor drive.

The guide means for the window support may be formed in the conventional manner by a slider which is fixed to or formed on the window support and slides along a fixed rail.

In some cases, for example when it concerns a window-raiser for a rear door of an automobile vehicle in which the window is particularly well guided, the slider and the rail may be eliminated and a faultless guiding achieved merely by the effect of parallel lateral slideways in which the corresponding edges of the window slide. The assembly is then such that the axis of the pivotal connection pin for the rack intersects the vertical from the centre of gravity of the window.

It is also possible to do away with the slider and the rail even in the case where the window is imperfectly guided in its slideways, by doubling the actuating means and disposing them in a substantially symmetrical manner relative to an axis passing approximately through the centre of gravity of the window. The assembly then comprises two drive pinions and two racks the pivotal connection pins of which are spaced apart on the support which may then be formed by a simple bar. As in the case of window-raisers having divergent arms, equal forces are consequently applied to the window support at two symmetrically disposed points.

The elimination of the slider obviously permits reducing still further the overall size or increasing the effective travel for a given overall size.

Further features and advantages of the invention will be apparent from the ensuing description which is given merely by way of example with reference to the accompanying drawings in which.

Figures 6, 8:
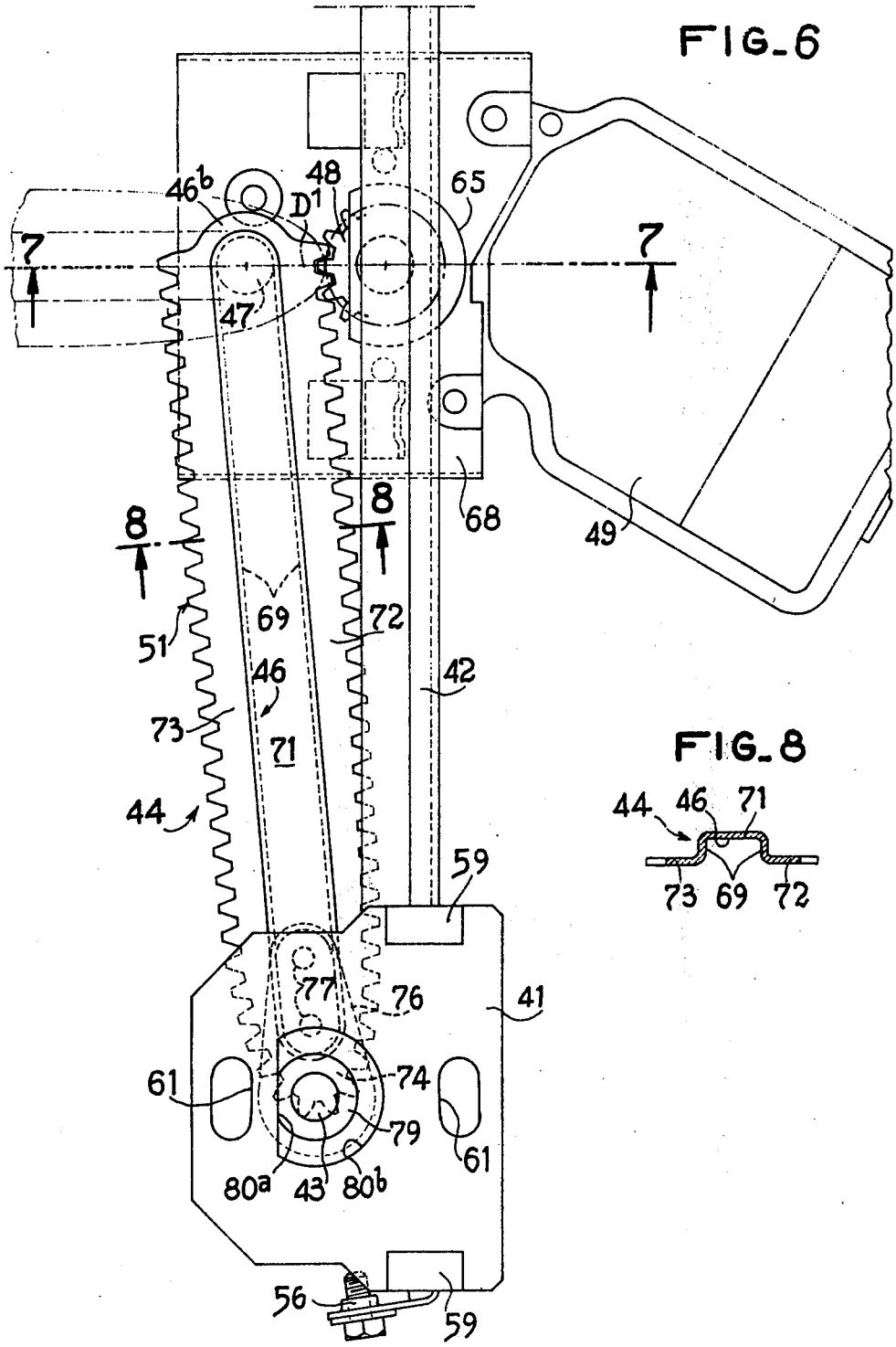
FIG. 6 is an elevational view of a window-raiser similar to that shown in FIG. 5, applied to a curved door and window and comprising a slider and a guide rail.
Figure 7:
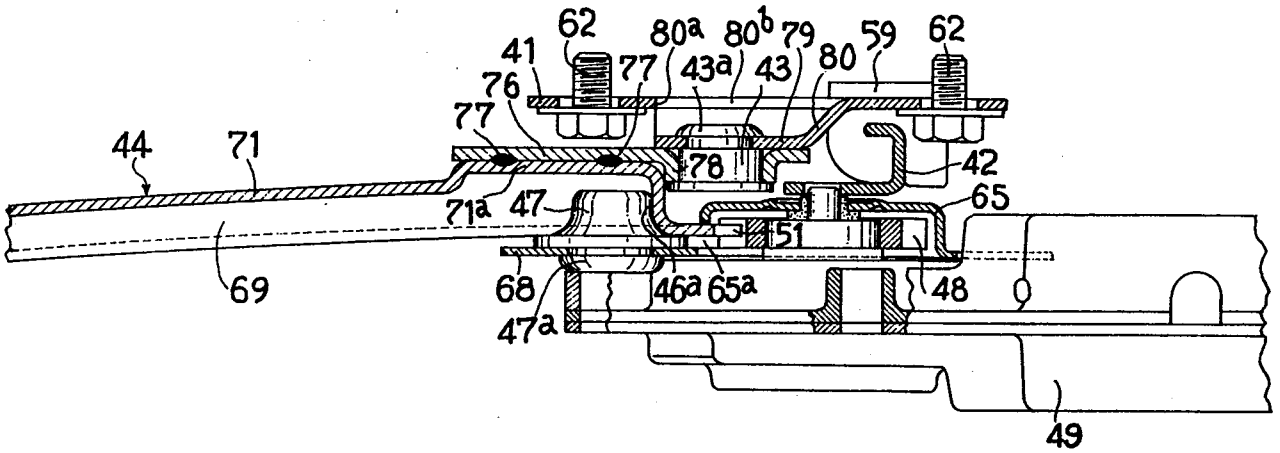
Figure 9:
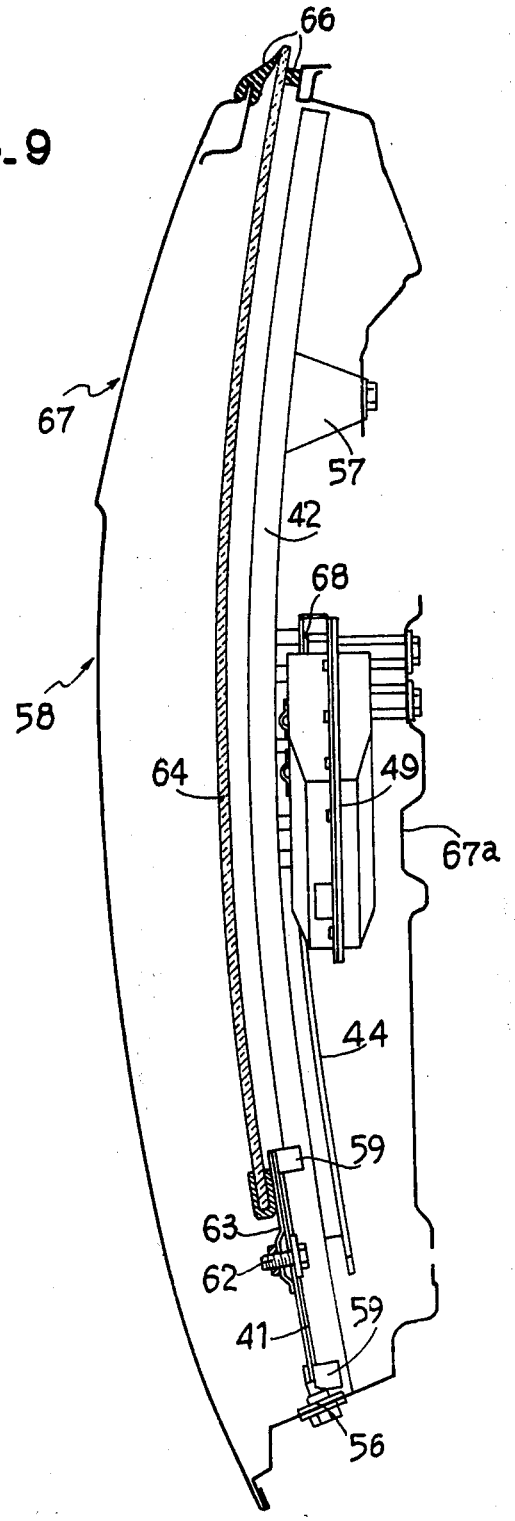
Figure 10:
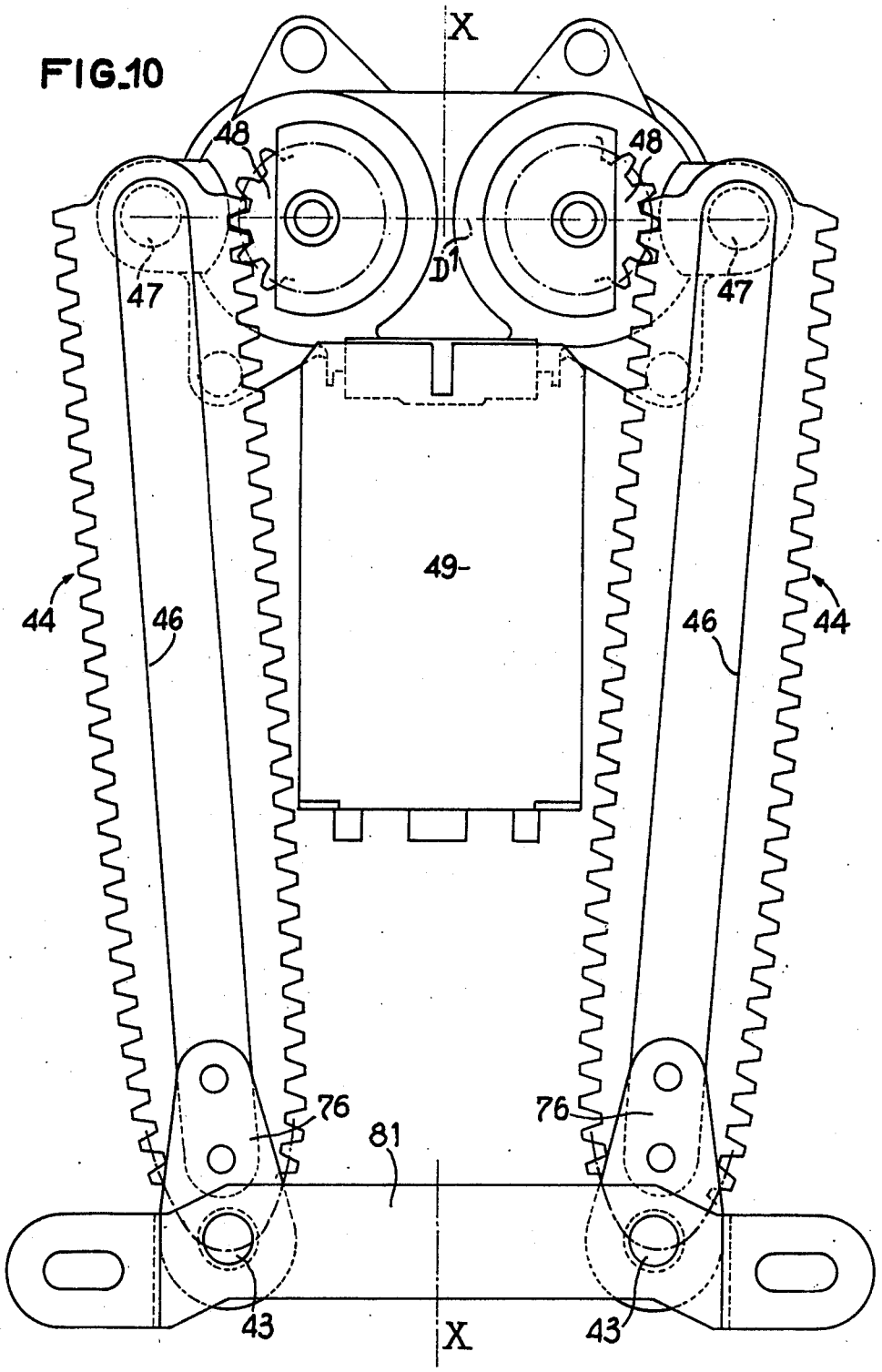
Figure 11:
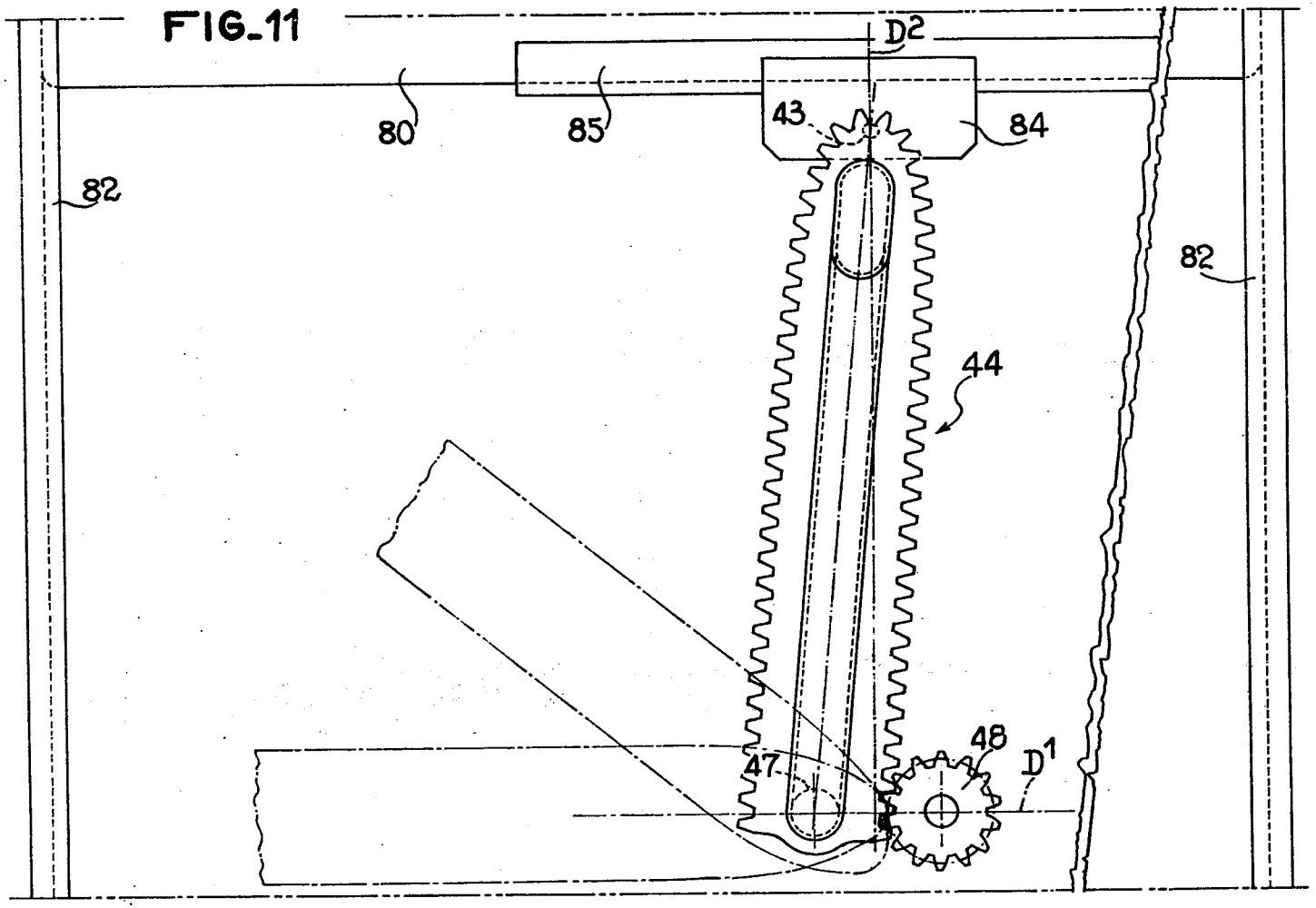

FIGS. 7 and 8 are sectional views taken on lines 7—7 and 8—8 of FIG. 6;

FIG. 9 is a vertical cross-sectional view of a door provided with the window-raiser shown in FIG. 6;

FIG. 10 is an elevational view of a window-raiser according to the invention without a guiding slider and having a double rack, and FIG. 11 is an elevational view of a window-raiser according to the invention which has no guiding slider and a single rack.

Figure 1:
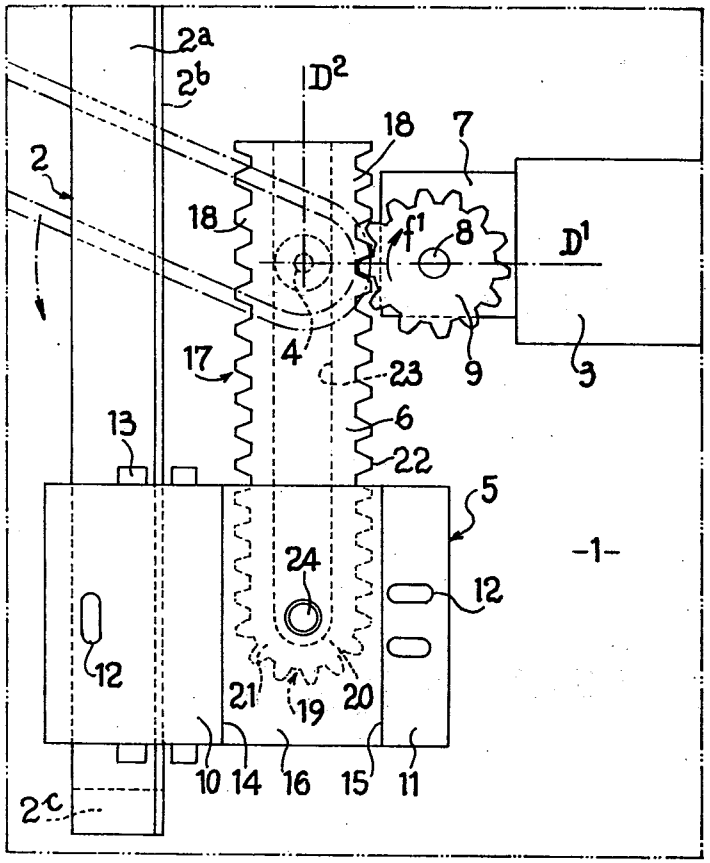
FIG. 1 is a diagrammatic plan view illustrating the principle of operation of a first embodiment of a window-raiser according to the invention.

The window-raiser shown in FIG. 1 comprises three elements fixed to a door panel 1 of an automobile vehicle provided with two vertical window or glass slideways (not shown): namely a guide rail 2, an electric motor 3 and a pivot 4. It further comprises a window support slider 5 guided along the rail 2, and a rack 6 for actuating or shifting the slider.

It will be assumed that the door panel 1 is planar and vertical. The rail 2 is vertical and formed by an L-section member whose flange $2^a$ is parallel to, but spaced away from, the panel 1, it being secured for example with the use of two end spacer blocks $2^c$ only one which is shown. The other flange $2^b$ of the L is perpendicular to the flange $2^a$ and extends from the latter in a direction away from the panel 1.

The motor 3 is provided with a speed reducer 7 the output shaft 8 of which is perpendicular to the door panel 1. Keyed on this shaft 8 is a drive gear pinion 9 capable of rotating in both directions.

The pivot 4 is cylindrical; the straight line $D^1$ connecting its centre to the centre of the pinion 9 is perpendicular to the rail 2 and positioned in the middle of the latter.

The slider 5 comprises two planar end parts 10 and 11 which are contained in the same plane and provided with apertures 12 for securing thereon a window or glass support arm (not shown). The part 10 of the slider carries, on the side thereof facing the door panel 1, tabs 13 which are located on opposite sides of the branch $2^b$ of the rail 2 so as to guide the slider along this rail. In operation, the slider is maintained parallel to the panel 1 by the base of the window or glass owing to the guiding of the edges of the window (with which the slider is rigid) in the slideways of the vehicle door.

The parts 10 and 11 of the slider are united by an intermediate U-shaped part formed by two opposed projecting parts 14, 15 perpendicular to the door panel and a part 16 parallel to the latter and forming a rack support. The spacing between the support 16 and the door panel is at the most equal to the spacing between the latter and the flange $2^a$ of the rail 2.

The rack 6 comprises a first portion 17 formed by a rectilinear Ω-section member which has two parallel branches which extend toward the door panel and are spaced apart a distance corresponding to the diameter of the pivot 4. Each of these branches is connected at its end to a toothed outwardly-extending flange 18 which is parallel to the panel 1.

The rest 19 of the rack 6 is formed by a semi-cylindrical portion 20 whose inside diameter and height are respectively equal to the inner width and the height of the Ω-section portion 17. This semi-cylindrical portion is open in the direction of the lower part of the door 1 and has at this end a planar flange 21 which is toothed and is in the shape of a semi-ring whose width is the same as the width of the flanges 18.

The portions 17 and 19 of the rack are in adjoining relation so that the latter has a continuous U-shaped set of teeth 22 and a blind longitudinal slot 23. In fact, the portions 17 and 19 of the rack 6 form part of a single piece.

A pin 24 having a head, which is for example riveted, pivotally connects the rack 6 by the centre of its semi-circular portion to the side of the slider portion 16 which faces the panel 1. Consequently, the rack is freely pivotable relative to the slider 5 in a direction parallel to the latter owing to the permanent contact between the end of the slot 23 and the portion 16 of the slider. The straight line $D^2$ which connects the centre of the pivot 4 and the centre of the pivotal connection pin 24 when the pinion 9 is in mesh with a rectilinear portion of the set of teeth 22 is parallel to the rail 2.

The window-raiser just described operates in the following manner:

It will be assumed that the window-raiser is in a position in the neighbourhood of that shown in FIG. 1, with the pinion 9 in mesh with the open end part of the rectilinear portion of the teeth 22 and the pin 24 located in a position lower than the pivot 4. This corresponds to the lower end or limit position of the associated window.

The motor 3 is started up so as to rotate the pinion 9 in the direction of arrow $f^1$. The rack 6, guided by the pivot 4, rises and drives the slider 5, and consequently also the window, upwardly along the rail 2.

When the pin 24 reaches a position of axial alignment with the pivot 4, the latter fits in the semicylindrical portion 20 and the pinion starts to mesh with the semi-circular portion of the teeth 22. It will be understood that the various component parts are so arranged as to permit this axial alignment.

The rotation of the pinion 9 then causes the rack to pivot about the pivot 4 as shown in dot-dash lines in FIG. 1 without displacing the slider. This pivoting is possible owing to the spacing between the rail and the door panel which allows the passage of the pivoting rack.

When the rack has pivoted through 180°, the pinion 9 again starts to mesh with a rectilinear portion of the teeth 22, namely the portion opposite to the initial portion, and the rack resumes its uniform upward motion, the pivot 4 moving relative thereto to within the vicinity of its open end.

End-of-travel stops are of course provided. It will be understood that the total travel of the slider is equal to twice the length of the portion 17 of the rack. The overall height of the window-raiser is therefore much reduced and the travel of the slider may be equal to the available height within the door panel.

The slider is made to descend in the same manner by reversing the direction of rotation of the drive pinion 9.

Figure 2:
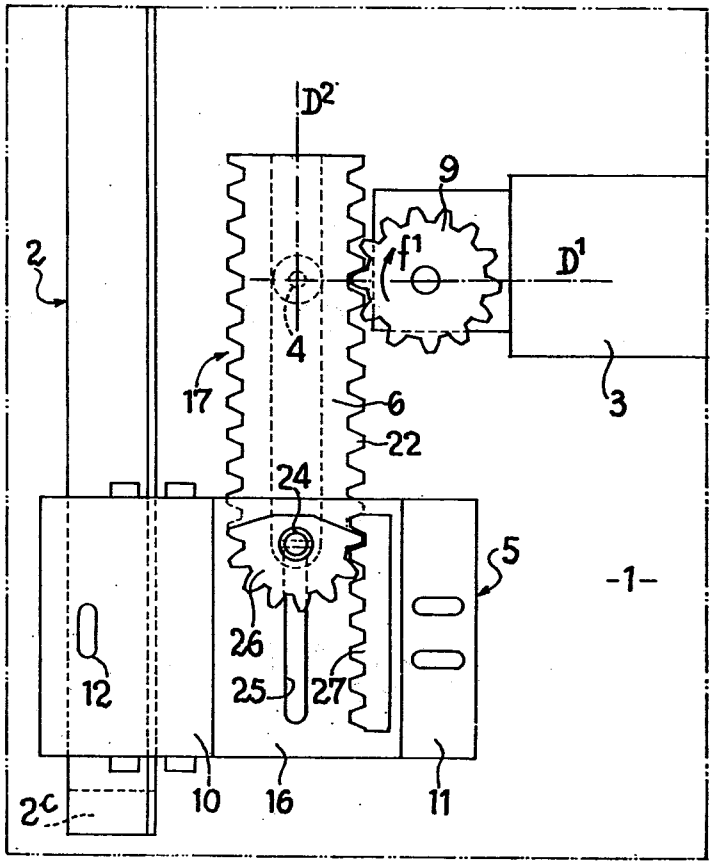
FIG. 2 is a similar view illustrating the principle of operation of a second embodiment of a window-raiser according to the invention.

The window-raiser shown in FIG. 2 is on the whole identical to that shown in FIG. 1 except that the pin 24 does not extend through a circular aperture of the part 16 of the slider but a slot 25 parallel to the rail 2. The length of the slot 25 ie equal to or, by way of a modification, exceeds the effective development of the toothed semi-circular portion of the rack plus the diameter of the pin 24. Moreover, the latter serves to fix to the rack a semi-circular toothed sector 26 which is exactly superimposed on the toothed semi-circular portion of the rack. In the illustrated embodiment, the part 16 of the slider is located between this semi-circular portion and the sector 26.

Any suitable means, for example a flat (not shown) on the pin 24, can serve to prevent the sector 26 from rotating relative to the rack. This sector 26 is permanently meshed with a secondary rack 27 which has an effective length equal to at least the development of the sector 26 and is fixed to the part 16 of the slider and extends in a direction parallel to the rail 2.

This window-raiser operates on the whole in the same way as the window-raiser shown in FIG. 1. However, considering the upward travel of the slider, when the pinion 9 meshes with the semi-circular portion of the rack and pivots the rack through 180°, the sector 26 at the same time rotates about the same axis, namely the axis of the pivot 4, and displaces the secondary rack 27 and therefore the slider at the same speed and in the same direction as when the pinion 9 meshed with the rectilinear portion of the teeth 22. Consequently, there is produced a rolling of the sector 26 on the rack 27 without sliding and simultaneously a relative displacement of the pin 24 from the upper end to the lower end of the slot 25. When the rack has pivoted through 180°, it is urged upwardly as in the embodiment shown in FIG. 1. In this way, the sector 26 operates instead of the rack 6 between the two operative stages of the latter and the speed of displacement of the slider is uniformly continuous throughout the upward or downward travel thereof.

The advantage of the window-raiser shown in FIG. 2 resides in the fact that, at the expense of a minor complication, the temporary stoppage of the slider during the rotation of the rack is avoided, which is more rational and quicker and avoids a waste of energy. Moreover, the travel of the slider is increased by the development of the toothed semi-circle. For a given travel, it is consequently possible to reduce still further the length of the rack and consequently the overall size of the window-raiser.

Figure 3:
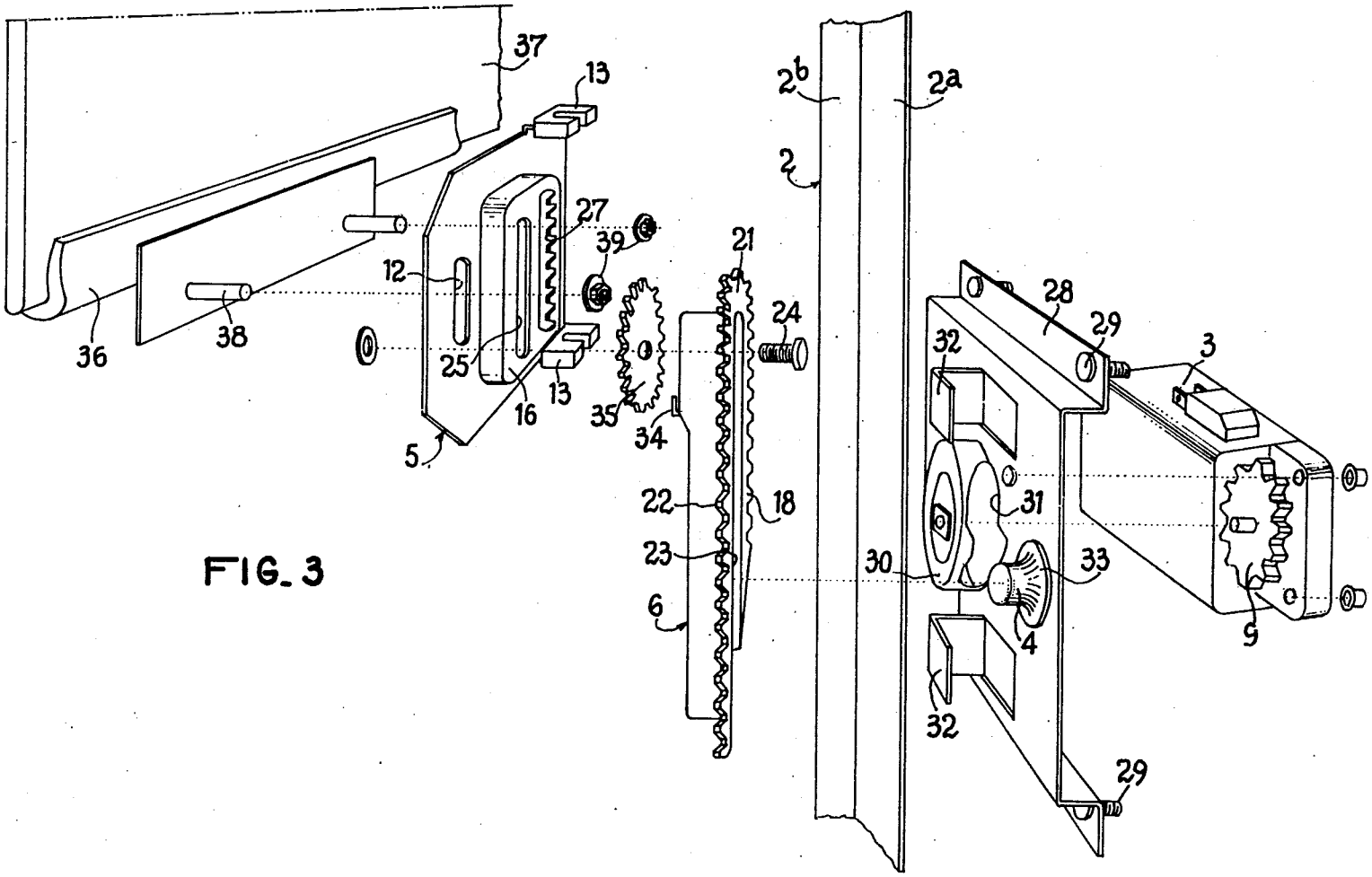
FIG. 3 is an exploded perspective view of a window-raiser which operates in accordance with the principle illustrated in FIG. 2.
Figure 4:
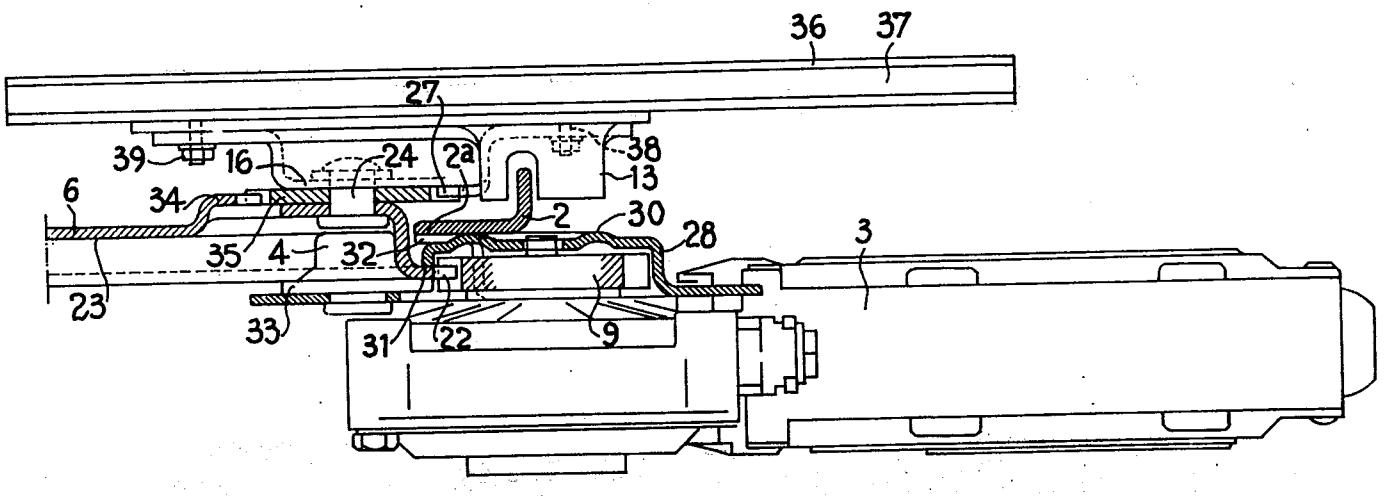
FIG. 4 is a horizontal sectional view of the window-raiser shown in FIG. 3, the rack being in the course of pivoting.

FIGS. 3 and 4 show a practical embodiment of a window-raiser in accordance with the principle illustrated in FIG. 2. The same component parts are shown and consequently will not be described again in detail.

A support plate 28 is provided and may be secured by screws 29 to the door panel (not shown). Adjacent the latter, the plate carries the motor 3 and the gear pinion 9 is received in a cylindrical housing 30 which projects from the other side of the plate and defines a lateral opening 31.

Projecting from the same side of the plate 28 as the housing 30 are two L-shaped partly sheared and formed portions 32, to which the rail 2 is welded, and the pivot 4 which has an annular flange 32 at its base.

The projecting centre part 16 of the slider 5 is substantially parallel-sided and the secondary rack 27 is in one piece therewith.

The rack 6 differs from that shown in FIG. 2 in that its longitudinal cavity or slot 23 is deeper at its blind end. In this region, a partly sheared and formed portion 34 prevents rotation of a gear wheel 35 which performs the function of the sector 26 shown in FIG. 2.

Shown in FIGS. 3 and 4 is the window base or support 36 which carries the window or glass 37 to be shifted and has two screwthreaded rods 38 which extend through the apertures 12 in the slider and are secured by nuts 39.

FIG. 4 clearly shows the relative disposition of various component parts of the window-raiser in the assembled state thereof. The teeth 22 of the rack extend into the opening 31 of the housing 30 and mesh with the pinion 9 and its toothed flange is in contact with the flange 33 of the pivot 4. The deepest part of the slot 23 of the rack permits the superimposition of the head of the pin 24 and the pivot 4 during the rotation of the rack through 180°.

The projecting part 16 of the slider merely serves to receive the other head of the pin 24. Indeed, the arrangement of the rail 2 on the same side of the pivot 4 as the pinion 9 has for result that the rack rotates in the direction away from the rail. Consequently, there is no danger of the latter hindering it and it is unnecessary to shift the rack in a plane other than the plane of the branch $2^a$ of the rail. The assembly can therefore be thinner, which is an advantage when placing it in the reduced space in the lower part of a door.

Note that the presence of the plate 28 results in a compact assembly which is easy to mount and pack for transport and storage.

It is clear that in the various embodiments, the pinion 9 may be actuated by a crank. However, the guide rail must be in practice at least in the vicinity of the centre of gravity of the window or glass and, in order to avoid risk of a wedging of the slider, the pivot 4 must be close to the rail. This limits the possible distance between the rail and the axis of the pinion 9. Now, most often, the position of the crank must be close to the forward part of the door for convenience of actuation. Consequently, transmission means must be provided between this crank and the pinion 9 and this complicates the window-raiser. Of course, these drawbacks are avoided when actuating the window-raiser with a motor 3 since the latter may be disposed anywhere within the door panel. This is why the invention is especially adapted to this case.

The window-raisers according to the invention may be easily adapted to the case of curved doors and windows. It is sufficient to bend the rail 2 and the rack 6, which in no way hinders the movements and the pivoting of the rack. This pivoting may in particular then occur in the curve of the window where the free space is of maximum width.

The window-raiser shown in FIGS. 3 and 4 is mainly of metal, the slider 5, the rack 6 and the plate 28 being of a sheet metal pressing. However, the low actuating torque that the pinion 9 may exert on the rack 6 makes it possible to provide cheaper teeth of plastics material, those of the two racks and pinion then having a greater thickness, which is possible without increasing the overall thickness of the assembly, as is clear from FIG. 4. This possibility enables more precise helical teeth to be provided, whereas such teeth are too expensive to form in metal parts.

Figure 5:
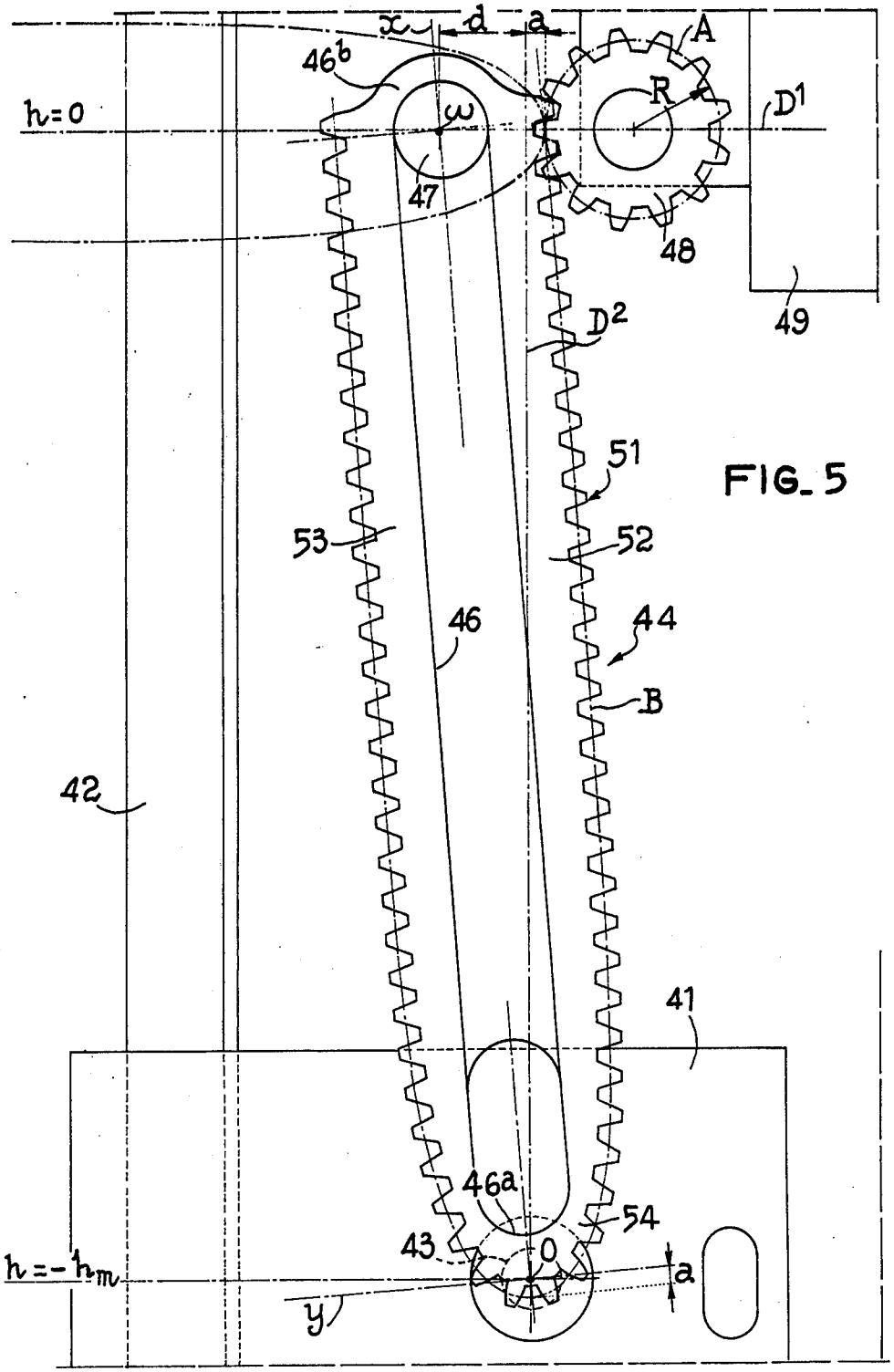
FIG. 5 is a diagrammatic view of a third embodiment of a window-raiser according to the invention.

FIG. 5 shows diagrammatically another window-raiser according to the invention in which it is assumed that all the geometric elements of utility to the description are projected in the plane of the drawing. The window-raiser comprises a window or glass support formed by a slider 41 which is slidably mounted on a fixed vertical rail and on which is pivotally mounted by means of a pin 43 one of the end portions of a slideway or rack 44 in the slot 46 of which is engaged a guide pin or pivot 47 which is fixed and has a centre located on a straight line $D^1$ perpendicular to the straight line $D^2$ representing the vertical path of translation of the centre O of the pivotal connection pin 43 of the slideway. The straight line $D^1$ intersects the centre of a pinion 48 which is driven in rotation by an electric motor 49 and meshes with teeth 51 formed on the slideway 44. The guide pin 47 is laterally offset from the line $D^2$ in a direction away from the pinion 48, this line $D^2$ being located outside the pitch circle A of radius R of the pinion 48 at a distance a from this circle. The distance between $D^2$ and the centre $\omega$ of the pin 47 is equal to d.

In order to ensure a correct meshing between the toothed slideway 44 and the pinion 48 in all the positions of the slider 41, the pitch curve B of the teeth 51 of the slideway 44 must coincide with the envelope of the pitch circle A in the relative movement of the pinion 48 relative to the slideway. This curve, which is symmetrical relative to the straight line ω O and may be obtained by a geometric tracing out, is defined in Cartesian coordinates, with respect to the axis Ox coinciding with the axis of symmetry of the slideway and the axis Oy perpendicular to the axis Ox, by the following parametric equations:

$$x = R\sin\left[\text{Arc tan}\frac{d}{h} - \text{Arc tan}\frac{h}{R + a + d + \frac{h^2}{d}}\right] + \sqrt{h^2 + d^2} - d\frac{(R + a + d)}{\sqrt{h^2 + d^2}}$$

$$Y = \left[\sqrt{h^2 + (R + a + d + \frac{h^2}{d})^2} - R\right]\cos\left[\text{Arc tan}\frac{d}{h} - \text{Arc tan}\frac{h}{R + a + d + \frac{h^2}{d}}\right] - \sqrt{h^2 + \frac{h^4}{d^2}}$$

wherein the parameter h is the distance between the straight line $D^1$ and the centre O of the pivotal connection 43 between the slideway and the slider.

The teeth 51 defined in this way comprise two branches 52, 53 disposed on each side of the slot 46 and the end region 54 connected to the two branches. It therefore concerns a U-shaped or hair pin-shaped curve.

In the position shown in full lines in FIG. 5, the slider 41 occupies its lower end position corresponding to the fully-opened window or glass and to the value $-h_m$ of the parameter h. The slider 41 can move from this position to the other end position (not shown) which is as a rule symmetrical with the first-mentioned position, corresponding to the closure of the window or glass and to the value $+h_m$ of the parameter, under the effect of the driving, in a simultaneous movement of translation and rotation, of the slideway 44 due to the rotation of the pinion 48 which meshes in succession with the branch 52, the end arcuate portion 54 and the branch 52 of the teeth 51. In the midway position, shown in dot-dash lines, the axis Ox of the slideway coincides with the straight line $D^1$ (h=0) and the guide pin 47 is in abutment with the end 46$^a$ of the slot 46 which is adjacent to the end of the teeth 52. The other end 46$^b$ of the slot is also closed and thereby defines the end-of-travel positions of the slider.

In one embodiment the following dimensions were adopted for the magnitudes employed in the foregoing equations:

R=15.75 mm
a=2 mm
D=18 mm

Thus it is clear from FIG. 5 and the foregoing that the pivotal connection pin 43 of the slideway is in the immediate vicinity of the end of the slideway teeth 51, with the distance between the centre O and the end of the curve B being equal to a.

If the tangential speed of the drive pinion 48 is designated by $v_o$, the speed of translation v is given by the following expression:

$$V = v_o\left(d + \frac{h^2}{d}\right)\frac{1}{\sqrt{h^2 + (R + a + d + \frac{h^2}{d})^2} - R}$$

If $v_o$ is constant, v is not constant, but the maximum variation of v is on the order of only 13%, so that it can be said that the movement of the slider, and consequently the window, is substantially uniform.

In FIGS. 6 to 9, the guide rail 42 is fixed at 56 and 57 to a curved door panel 58 and is slightly bent in the transverse plane of FIG. 9. Formed in the slider 41, which is slidably mounted on the rail by shoes 59, are openings 61 for the passage of screws 62 for securing the base of the window 63 on which a curved window or glass 64 is mounted, this window being in sealed sliding contact with members 66 provided at the upper end of the lower part 67 of the door. The rail 42 is located, in the main plane of the door panel, in alignment with the drive pinion 48 which is disposed in a circular cavity 65 pressed in a plate 68 which is rigid with the slide 67$^a$ of the lower part of the door and also supports the guide pin 47, retained by a riveting 47$^a$, and the electric drive motor-speed reducer unit 49 (FIGS. 7 and 9. The side of the cavity 65 is cut out at 65$^a$ to allow the passage of the teeth of the slideway 51. Note that FIG. 7 corresponds to the midway position of the travel of the slideway in which the axis of symmetry of the latter coincides with the straight line $D^1$, the slider 41 being then superimposed on the plate 65.

The toothed slideway 44, which is also bent or curved (FIG. 7), has an Ω-section (FIG. 8) the sides 69 and the bottom 71 of which define the slot 46. The teeth 51 are formed on the edge of the planar flanges 72, 73 of this Ω-section and on an arcuate region 74 interconnecting the flanges in the end region of the slideway. Fixed on the outer face of a raised portion 71$^a$ of the bottom 71 by welding at 77 is a plate 76 which comprises a cylindrical portion 78 which forms a bushing or bearing and is located beyond the end 46$^a$ of the slot 46 and in which there is engaged a pivot pin 43 which is fixed at one of its ends by a riveting 43$^a$ to a planar portion 79 of the slider 41 formed in a partly sheared and formed portion 80 of the latter, the sheared shape of which comprises a rectilinear portion 80$^a$ and a part-circular portion 80$^b$.

In the window-raiser shown in FIG. 10, also assumed to be applied to a curved door, the slider and the guide rail are eliminated owing to the self-guiding obtained by the fact that the actuating means are double and disposed symmetrically relative to the axis X—X which approximately intersects the centre of gravity of the window or glass. Two drive pinions 48 are provided which are driven in synchronism by the motor 49 and mesh with the two toothed slideways 44 which are pivotally connected at 43 to the window support which is formed by a simple bar 81.

The geometry or configuration of a particular door may require an arrangement or disposition which is slightly different from the strictly symmetrical arrangement of FIG. 10. In any case, the assembly is such that the window support is driven at two spaced-apart points under conditions which ensure that the window moves with no danger of wedging.

In the embodiment shown in FIG. 11, the window-raiser is assumed to be employed for controlling or shifting a window or glass 80 which is planar or curved and whose edges slide in parallel slideways 82. The quality of the guiding provided in this way is considered to be sufficient to dispense with the slider and the rail also in this case, although the window-raiser comprises, as in the embodiment shown in FIG. 6, a single drive pinion 48 and a single slideway 44, the pivotal connection pin 43 of which travels through a path $D^2$ which passes approximately through the centre of gravity of the window. The window support is formed by a member 84 to which the window base 85 is secured. The slideway 44 is shown in its upper end position. Intermediate positions are shown in dot-dash lines.

Having now described my invention what I claim as new and desire to secure by Letters patent is:

1. A window-raiser comprising a window support, guide means and actuating means for said support for displacing said support in substantially rectilinear translation, the actuating means comprising a U-shaped rack having an apex and defining a longitudinally extending slot, a pin pivotally connecting the rack in the region of the apex of the U to said support, a drive gear pinion having a fixed axis and meshed with the rack, and a fixed pivot received in the slot of the rack.

2. A window-raiser as claimed in claim 1, wherein a straight line connecting, in plan, the centre of the pivot to the centre of the pinion is perpendicular to the direction of said displacement of said support.

3. A window-raiser as claimed in claim 1, wherein said slot of the rack has a cross-sectional guiding shape, said slot being blind adjacent to the apex of the U so as to form an abutment for the pivot when the drive pinion meshes with the region of the apex of the U.

4. A window-raiser as claimed in claim 3, wherein the cross-sectional guiding shape is an Ω shape.

5. A window-raiser as claimed in claim 1, wherein the teeth of the rack comprise two rectilinear parallel portions and a semi-circular portion interconnecting the two parallel portions, the pin extending through the centre of said semi-circular portion and the axis of the pivot and the centre of the semi-circular portion being coincident when the drive pinion meshes with said semi-circular portion.

6. A window-raiser comprising a window support, guide means and actuating means for said support for displacing said support in substantially rectilinear translation, the actuating means comprising a U-shaped rack having an apex and defining a longitudinally extending slot, a pin pivotally connecting the rack in the region of the apex of the U to said support, a drive gear pinion having a fixed axis and meshed with the rack, and a fixed pivot received in the slot of the rack, the teeth of the rack comprising two rectilinear parallel portions and a semi-circular portion interconnecting the two parallel portions, the pin extending through the centre of said semi-circular portion and the axis of the pivot and the centre of the semi-circular portion being coincident when the drive pinion meshes with said semi-circular portion, a semi-circular member being superimposed on and carried by said semi-circular portion of the rack and having the same effective circumference as said semi-circular portion, and a track which is parallel to the direction of said displacement of the window support and rigid with the window support and cooperating with said semi-circular member without sliding, a slot in the support which is parallel to the track receiving the pivot pin which extends therethrough.

7. A window-raiser as claimed in claim 6, wherein the semi-circular member and the rack are toothed.

8. A window-raiser as claimed in claim 4, wherein a portion of the longitudinally extending slot adjacent to said apex of the U is deeper to enable the axial alignment of the pivot and a head of the pivotal connection pin.

9. A window-raiser as claimed in claim 1, 2 or 3, wherein a riveting secures the pivot pin to the rack.

10. A window-raiser comprising a window support, guide means and actuating means for said support for displacing said support in substantially rectilinear translation, the actuating means comprising a U-shaped rack having an apex and defining a longitudinally extending slot, a pin pivotally connecting the rack in the region of the apex of the U to said support, a drive gear pinion having a fixed axis and meshed with the rack, and a fixed pivot received in the slot of the rack and laterally offset from the path of the pin in a direction away from the pinion, the teeth of the rack comprising two branches of slight curvature disposed on opposite sides of the slot and an end portion having a high curvature and connected to the two branches and located adjacent to the pin.

11. A window-raiser as claimed in claim 10, wherein, in a system of Cartesian coordinates the axes of which are an axis of symmetry of the rack and an axis perpendicular to said axis of symmetry, the envelope curve is defined by the following parametric equations:

$$x = R\sin\left[\text{Arc tan}\,\frac{d}{h} - \text{Arc tan}\,\frac{h}{R + a + d + \frac{h^2}{d}}\right] + \sqrt{h^2 + d^2} - d\,\frac{(R + a + d)}{\sqrt{h^2 + d^2}}$$

$$Y = \left[\sqrt{h^2 + (R + a + d + \frac{h^2}{d})^2} - R\right]\cos\left[\text{Arc tan}\,\frac{d}{h} - \text{Arc tan}\,\frac{h}{R + a + d\frac{+ h^2}{d}}\right] - \sqrt{h^2 + \frac{h^4}{d^2}}$$

wherein:

R is the radius of the pitch circle of the drive pinion, a is the distance between the centre of the pivot and the rectilinear path of the centre of the pin, the parameter h is the distance between the centre of the pin and a straight line connecting the centre of the pivot to the centre of the drive pinion and perpendicular to said rectilinear path of the centre of the pin.

12. A window-raiser as claimed in claim 1, 2 or 3, wherein the end of the slot opposed to the pin is closed so as to form an end-of-travel abutment.

13. A window-raiser as claimed in claim 1, wherein two of said actuating means are provided and disposed substantially symmetrically relative to an axis which defines said translation of said support.

14. A window-raiser as claimed in claim 13, wherein the actuating means comprise two drive pinions and two racks whose pivotal connection pins are spaced-apart.

15. A window-raiser as claimed in claim 1, 2 or 3, wherein the guide means comprise parallel slideways in which lateral edges of the window are slidable, the axis of the pivotal connection pin intersecting the vertical from the centre of gravity of the window.

16. A window-raiser as claimed in claim 10 or 11, comprising a plate fixed to an end of the slot of the rack, the plate comprising a portion located beyond said end of the slot in the vicinity of the apex of the U and through which the pivotal connection between the rack and the window support is achieved.

17. A window-raiser as claimed in claim 1, 2 or 3, wherein the surface containing the teeth of the rack is curved at substantially the radius of curvature of the window measured in the direction of said displacement of the window support.

18. A window-raiser as claimed in claim 1, 6 or 10, comprising an electric motor drivingly connected to the drive pinion.

19. A window-raiser as claimed in claim 1, 6 or 10, comprising a rail and a plate provided with means for fixing the plate to an automobile door panel, the window support comprising a slider guided on the rail, and the drive pinion, the pivot and the rail being carried by said plate.

* * * * *